United States Patent [19]

Catano et al.

[11] 4,300,468

[45] Nov. 17, 1981

[54] POSITION INTERLOCK SYSTEM FOR SUBMARINE MASTS AND CLOSURE

[75] Inventors: Paul S. Catano; Malvyn C. McDonald, both of San Diego, Calif.

[73] Assignee: The United States of America as represented by the Secretary of the Navy, Washington, D.C.

[21] Appl. No.: 133,238

[22] Filed: Mar. 24, 1980

[51] Int. Cl.[3] ..... B63G 8/38

[52] U.S. Cl. ..... 114/340; 343/710

[58] Field of Search ..... 114/339, 340, 126; 89/41 C, 40 B, 1.806, 1.809, 1.810, 1.812, 5; 343/709, 710, 894, 901, 899, 889; 340/686, 545; 350/302; 73/86, 187; 244/102 SL; 49/26, 28

[56] References Cited

U.S. PATENT DOCUMENTS

| | | | |
|---|---|---|---|
| 522,177 | 6/1894 | Holland | 114/340 X |
| 867,982 | 10/1907 | Lake | 114/340 X |
| 2,149,177 | 2/1939 | Miller | 49/26 X |
| 2,875,442 | 2/1959 | Benis | 343/889 |
| 2,914,922 | 1/1959 | Gibson | 343/901 X |
| 3,088,377 | 5/1963 | Siegel | 89/1.81 |
| 3,287,618 | 11/1966 | Stephens | 49/28 X |
| 3,431,678 | 3/1969 | Stuart | 49/28 X |
| 3,545,837 | 12/1970 | Chapman | 89/40 B |
| 3,669,387 | 6/1972 | Lucien | 244/102 SL |
| 3,691,846 | 9/1972 | Ingold | 73/86 X |
| 3,739,364 | 6/1973 | Talkington | 340/686 X |
| 4,048,638 | 9/1977 | Cejka | 343/894 |
| 4,134,327 | 1/1979 | Piesik | 89/1.812 X |
| 4,194,432 | 3/1980 | Conway | 89/41 C |

FOREIGN PATENT DOCUMENTS

| | | | |
|---|---|---|---|
| 2432063 | 1/1976 | Fed. Rep. of Germany | 49/26 |

*Primary Examiner*—Trygve M. Blix
*Assistant Examiner*—John C. Paul
*Attorney, Agent, or Firm*—Richard S. Sciascia; Ervin F. Johnston; Thomas Glenn Keough

[57] ABSTRACT

A submarine's mast and its protective closure are prevented from inadvertently damaging each other while deploying or retrieving the mast and while securing the closure. Interconnected logic circuitry electronically prevents an improper actuation sequence so that the mast and closure do not collide. Mechanical linkages and fail-safes susceptible to corrosion and damage are eliminated thereby permitting more reliable operation from circuitry safely stowed inside the submarine.

6 Claims, 3 Drawing Figures

POSITION INTERLOCK SYSTEM FOR SUBMARINE MASTS AND CLOSURE

BACKGROUND OF THE INVENTION

Masts in the form of periscopes and antenna in the sail of a modern submarine are protected from ice and debris by a protective closure. Before such a mast is raised, the closure must open and be stowed out of the way to allow vertical travel by the mast. In addition, when the mast is up or in the extended position, the closure door must be prevented from closing on the mast. Usually, an operator actuates a mast and closure system by switching circuits and valves in the proper sequence. The operator uses input data from mast position indicators and closure position indicators to evaluate the situation and perform the step-by-step actuation sequence. Operation in the wrong sequence may result in damage to and perhaps catastrophic failure of both the mast and closure mechanisms. The current state of the art has concerned itself with mechanical go-no-go linkages and devices which permitted only a set chain of events. Unfortunately these mechanical devices are exposed to salt water and the mechanical stresses attended such an exposed deployment dispose the devices to failure with the expected results. In addition, all the known interlock systems rely on the human element to one degree or another. Ideally, a mast deployment system should be constantly self-monitoring through a system of logic to automatically evaluate critical situations and circumvent improper extension and retrieval sequences that have damage potential. Having such a capability, the human element is discounted to assure more reliable operation.

Thus, there is a continuing need in the state of the art for an automatic electronic mast and closure actuation system which removes the human factor from an operational sequence and which is safely disposed within a submarine.

SUMMARY OF THE INVENTION

The present invention is directed to providing an improvement for a system that electronically protects a submarine mast and its protective closure from collision. A first means selectively produces signals indicative of the mast's up and a mast's down condition while a second means produces signals indicative of an open-closure and a closed-closure position. Simultaneously, a means provides control signals to selectively raise and lower the mast and open and secure the closure. A logic circuitry means initiates discreet actuation signals to lower or to raise the mast and to open or to secure the closure only when discrete combinations of the mast-up and mast-down condition signals and the closure-open and the closure-secure signals are received to ensure protection of the submarine mast and its protective closure. Hydraulic displacements of the closure and the mast are effected by interconnected circuitry responsive to discrete actuation signals from the initiating means so as to assure more reliable operation.

It is a prime object of the invention to provide for protection of a submarine's mast and protective closure.

Yet another object is to provide a mast deployment and retrieval scheme which reduces the human factor and thereby reduces a contributing cause of failure.

Still another object is to provide electronically interoperatively cooperating logic circuitry for assuring that structural members outside of a submarine's hull are not damaged by mutual collision.

Another object is to provide an electronic means safely deployed within a submersible for assuring protection of an external mast and its protective closure.

Yet another object is to provide an electronic protection circuit which compensates for possible human errors.

A further object is to provide for fail-safe means, carried within the protected confines of a submersible, for electronically assuring protection of externally deployed mechanical structure.

These and other objects of the invention will become more readily apparent from the ensuing description and claims when taken with the associated drawings.

DESCRIPTION OF THE PREFERRED EMBODIMENT

Figure 1:
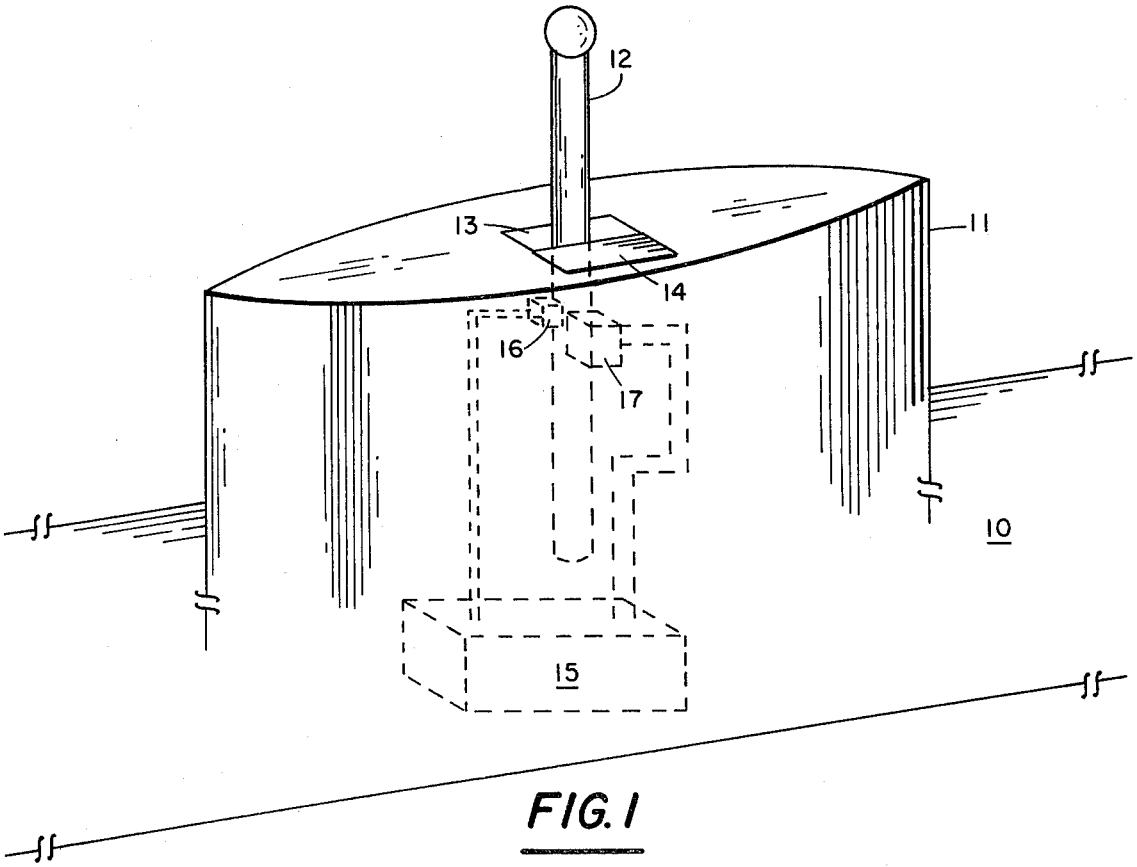
FIG. 1 portrays the operative environment of the inventive concept.

Referring now to the drawings, and in particular to FIG. 1, a submarine 10 of conventional design includes a sail 11 upwardly extending from its deck. The sail serves a variety of purposes among which is to provide a protective fairing for periscopes, antennas, other sensors etc., carried on a mast 12, extending through an opening 13.

Frequently, submarines operate in waters where ice, debris or other agents could damage the masts and their sensors within the sail. As a consequence, a door or closure 14 is provided to assure the integrity of the sail and its components when they are stowed within it.

The closure can be pivotally, slidingly or any one of a variety of mchanical coactions to effect an opening or closure of the opening so that a mast may be deployed and retrieved as desired. Due to the relatively delicate properties of the extensible mast and the sensor or instrumentation packages carried on it, it is essential that the open-deploy, retrieve-close sequence follows a strict procedure to avoid collision damage between the mast and closure.

For purposes of explanation regarding this invention, hydraulic actuators as part of a system 15 are schematically depicted in FIG. 1 and impart responsive displacements to the mast and closure when predetermined signal sequences are received. It is understood that such actuators are freely available in the state of the art as are the details of their interconnection with a typical mast and a closure.

Signals are produced by a first means 16 for producing signals indicative of the mast's position, those being a mast-up position or a mast-down position. A second means 17 produces signals representative of the closure's being in the open or secure position. The mast signal producing means and the closure signal producing means can be no more than micro switches suitably coupled to a potential source to provide a logical "1" and logical "0" or an "on-off" pulse or a "go", "no-go-" pulse depending on the designation desired.

Figure 2:
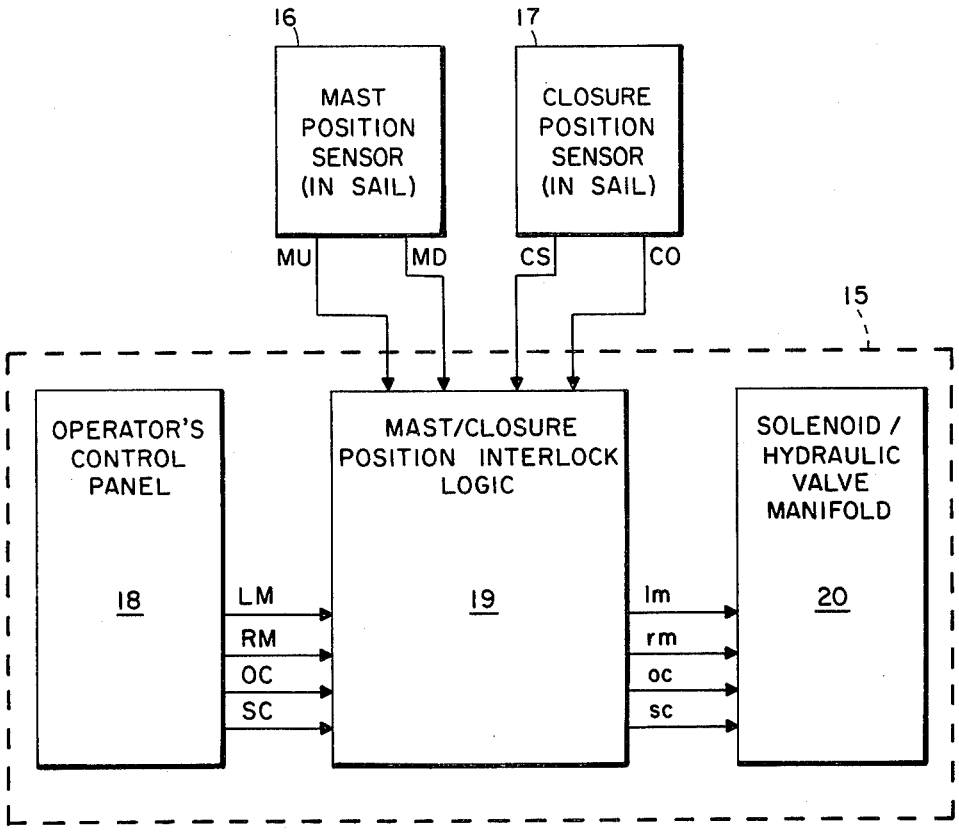
FIG. 2 sets forth a schematical block diagrammatical representation of the constituent elements of the invention.

The purpose of the signals produced by these sensors is to provide indicators as to what the current condition of the mast or the closure are, that is, mast-up, MU, or mast-down, MD, or closure-open, CO, or closure-secured, CS, see FIG. 2, respectively.

The indicator signals are fed to a logic network 18 for processing and correlation with control signals originating from a command control console or operators control panel 18. The console or panel provides signals when the submarine commander wishes to lower the mast, LM, raise the mast, RM, open the closure, OC, and secure the closure, SC, also see FIG. 2.

Except for the mast and closure sensors, all the other components are safely located inside the hull. Since the sensors can be packaged to resist damaging and corrosive ambient effects, the system's reliability is increased. The hull's structural integrity is not overly compromised by any cumbersome mechanical contrivance for all that is needed is one or two electrical hull penetrators to accommodate leads from the sensors.

Logic circuitry 19 includes an array of inverters, "AND" and "OR" circuits that receive and act upon position indicator signals from the mast and closure and from command signals coming from the control panel. After predetermined combinations of the control and indicator signals are received pseudo actuation signals are delivered to a hydraulic actuator 20 for responsive actuation to raise and lower the mast and to appropriately displace the closure.

As mentioned above, the four position indication signals coming from sensor 16 or sensor 17 indicate the position of the mast and the closure respectively. They are:

MU: indication that the mast is fully raised or up

MD: indication that the mast is fully retracted or down

CO: indication that the closure is fully opened

Figure 3:
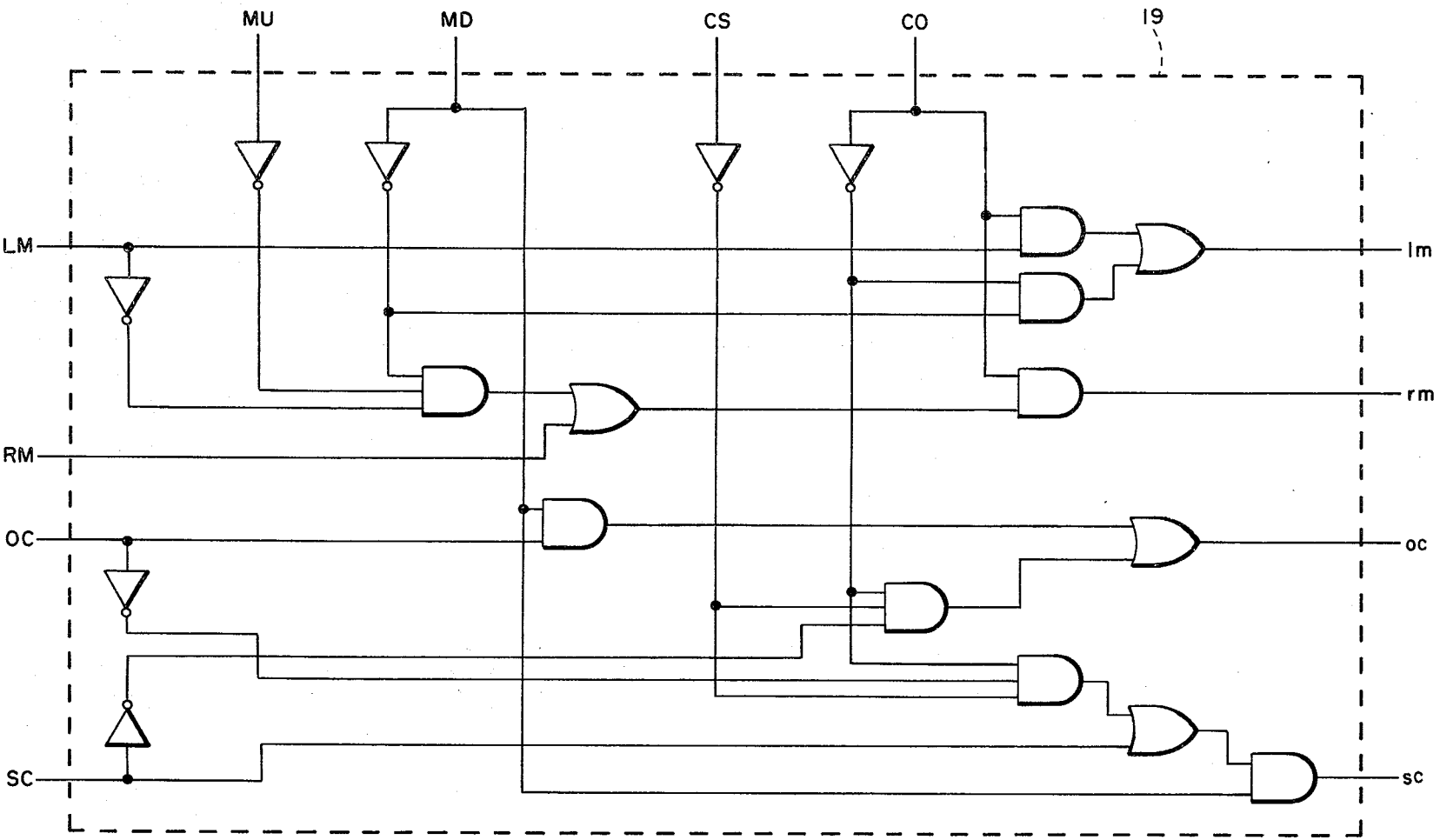
FIG. 3 sets forth, in somewhat greater detail, the circuitry forming the logic circuitry of the invention.

CS: indication that the closure is fully secured and appear as appropriate outputs for blocks 16 and 17 in FIG. 2 as well as appropriate input signals coming from the top of FIG. 3.

The four commands entered by an operator, at operator's control panel 18 in FIG. 2 are:

LM: operator's request for lowering or retracting the mast

RM: operator's request for mast extension or raising

OC: operator's request for opening of the closure

SC: operator's request for securing the closure

The polarities and magnitudes of the operator's requests (control signals from panel 18) are such as to logically agree with the polarities and magnitudes of the indicating signals coming from the mast and closure sensors to appropriately enable the logic circuitry of interlock logic 19.

Discrete combinations of the mast and closure sensor signals and the control signals are acted upon by the logic interlock to initiate actuation signals for hydraulic means coupled to manifold 20. The four actuation signals fed to the hydraulic actuator 20 to effect a raising and lowering of the mast and opening and closing of the closure are:

rm: raise-mast; causes hydraulic raising of the mast lm: lower-mast; causes hydraulic lowering of the mast oc: open-closure; causes hydraulic opening of the closure sc: shut-closure; causes hydraulic securing of the closure Given that a dot represents the logical "AND" function and a plus represents the logical "OR", an equation can be formulated for the initiation of the lm actuation signal:

$$lm = CO \cdot LM + \overline{MD}\ \overline{CO} \qquad (a)$$

Equation (a) allows the generation of an actuation signal to lower the mast if the closure is open and the operator requests mast retraction or if the closure is not fully open and the mast is not seated all the way down. This latter capability is necessary to prevent the mast's creeping up due to hydraulic malfunction or colliding with a closed or partially opened closure. In this regard the designation of the bar over a signal designation indicates the absence of the presence of the signal. For the purposes of this explanation, this condition is referred to as being the "NOT" presence of a signal. Thus, in equation (a) above it is apparent if the command signal lower-mast, LM, is given, the indication from mast sensor 16 would be that the mast is now down, $\overline{MD}$, since there is no positive indication that the mast is down and, hence, no MD signal, $\overline{MD}$, is generated. In like manner, the other signals indicating "NOT" conditions are designated.

An actuation signal to raise the mast, rm, is initiated according to the equation:

$$rm = CO \cdot [RM + \overline{MU} \cdot \overline{MD} \cdot \overline{LM}] \qquad (b)$$

Equation (b) allows the mast to be raised only if the closure is fully opened and the operator requests the mast up by feeding the raise-mast signal to the interlock logic and no contrary command has been given by the operator to lower the mast. In the absence of the lower-mast command the conditions of equation (b) will keep the mast all the way up by raising it automatically despite hydraulic creep that otherwise might be inherent in the system.

The signal for initiating the open-closure (oc) signal are shown:

$$oc = MD \cdot OC + \overline{CO} \cdot \overline{CS} \cdot \overline{SC} \qquad (c)$$

in which the closure is to be opened only if the mast is fully seated down and the operator sends a control signal opening the closure or if the closure is not shut and not fully opened (somewhere in between) and no command control signal has been given by the operator to shut the closure. The latter part is necessary to prevent the closure's creeping shut once it is open and the mast is not down.

Finally, a last actuation signal initiated by the interlock logic calls for the shutting of the closure (sc):

$$sc = MD \cdot [SC + \overline{CO} \cdot \overline{CS} \cdot \overline{OC}] \qquad (d)$$

The closure is allowed to be shut if the mast is fully seated down and the operator sends a command to shut the closure or if the closure is not open or down (somewhere in between) and no command has been given by the operator to open the closure. This latter part prevents the door from opening fully or partially due to hydraulic creep.

From the foregoing it is apparent that the cooperation between the sensor signals and command signals is assured by the interlock logic. The possibility of damage to the mast and closure is eliminated since only prearranged combinations of signals are workable and the human factor (error) is dismissed.

Obviously, many modifications and variations of the present invention are possible in the light of the above teachings, and, it is therefore understood that within the scope of the disclosed inventive concept, the invention may be practiced otherwise than as specifically described.

What is claimed is:

1. In a system for electronically protecting a submarine mast and its protective closure from collision an improvement therefor is provided comprising:

first means for selectively producing signals indicative of a mast-up and a mast-down condition;

second means for selectively producing signals indicative of an closure-open and a closure-closed position;

means for providing control signals to selectively raise and lower the mast and open and secure the closure;

means coupled to the first and second selectively producing signal means and the providing means for only initiating discrete actuation signals to lower and to raise the mast and to open and to secure the closure only when discrete combinations of the mast-up and mast-down condition signals and the closure-open and closure-closed signals are received thereby to ensure said protecting of the submarine mast and its protective closure.

2. An improvement according to claim 1 further including:

means coupled to receive the discrete actuating signals initiating means for effecting noninterfering hydraulic displacements of the submarine mast and protective closure.

3. An improvement according to claim 2 in which the discrete actuation signals initiating means includes a means for generating a lower-mast actuation signal in response to an closure-open signal from the second producing means and a lower mast control signal from the providing means and a not-mast-down signal from the first producing means and a not-closure-open signal from the second producing means.

4. An improvement according to claim 3 in which the discrete actuation signals initiating means includes a means for generating a raise-mast actuation signal in response to a closure-open signal from the second producing means, a raise-mast control signal from the providing means, a not-mast-up signal from the first producing means, a not-mast-down signal from the first producing means and a not-lower-mast control signal from the providing means.

5. An improvement according to claim 4 in which the discrete actuation signals initiating means includes a means for generating an open-closure actuation signal in response to a mast-down signal from the first producing means, an open-closure control signal from the providing means, a not-closure-open signal from the second producing means, a not-closure-closed signal from the second producing means and a not-secure-closure control signal from the providing means.

6. An improvement according to claim 5 in which discrete actuation signals initiating means includes a means for generating a secure-closure actuation signal in response to a mast-down signal from the first producing means, a secure-closure control signal from the providing means, a not-closure-open signal from the second producing means, a not-closure secure signal from the second producing means and a not-open-closure control signal from the providing means.

* * * * *